US008876628B2

(12) United States Patent
Hasegawa et al.

(10) Patent No.: US 8,876,628 B2
(45) **Date of Patent: *Nov. 4, 2014**

(54) GOLF CLUB SHAFT AND GOLF CLUB USING THE SAME

(71) Applicant: Dunlop Sports Co. Ltd., Kobe (JP)

(72) Inventors: Hiroshi Hasegawa, Kobe (JP); Takashi Nakano, Kobe (JP)

(73) Assignee: Dunlop Sports Co. Ltd., Kobe (JP)

( * ) Notice: Subject to any disclaimer, the term of this patent is extended or adjusted under 35 U.S.C. 154(b) by 106 days.

This patent is subject to a terminal disclaimer.

(21) Appl. No.: 13/644,971

(22) Filed: Oct. 4, 2012

(65) Prior Publication Data

US 2013/0095950 A1 Apr. 18, 2013

(30) Foreign Application Priority Data

Oct. 12, 2011 (JP) ..... 2011-224799

(51) Int. Cl.
*A63B 53/10* (2006.01)

(52) U.S. Cl.
CPC ..... *A63B 53/10* (2013.01); *A63B 2209/023* (2013.01); *A63B 2209/02* (2013.01)
USPC ..... 473/318

(58) Field of Classification Search
CPC ..... A63B 53/10; A01K 87/00; B32B 19/02
USPC ..... 473/318, 319, 292; 428/36.3
See application file for complete search history.

(56) References Cited

U.S. PATENT DOCUMENTS

| | | | | |
|---|---|---|---|---|
| 5,721,030 | A * | 2/1998 | Okada | 428/36.3 |
| 6,017,279 | A * | 1/2000 | Sumitomo | 473/316 |
| 6,056,648 | A * | 5/2000 | Kusumoto et al. | 473/319 |
| 7,326,125 | B2 * | 2/2008 | Moriyama | 473/292 |
| 2004/0009830 | A1 * | 1/2004 | Nishio | 473/345 |
| 2009/0029792 | A1 * | 1/2009 | Kumamoto | 473/319 |
| 2009/0264216 | A1 * | 10/2009 | Kato | 473/319 |
| 2009/0305811 | A1 * | 12/2009 | Matsumoto et al. | 473/319 |
| 2010/0022324 | A1 * | 1/2010 | Kato | 473/319 |
| 2011/0151991 | A1 * | 6/2011 | Matsumoto et al. | 473/319 |

FOREIGN PATENT DOCUMENTS

JP 2004-201911 A 7/2004

* cited by examiner

*Primary Examiner* — Michael Dennis
(74) *Attorney, Agent, or Firm* — Birch, Stewart, Kolasch & Birch, LLP

(57) ABSTRACT

A golf club shaft extending from a tip end to a butt end and made of fiber reinforced resin, comprises a weight being in a range of from 30 to 55 g, a whole length LS between the tip end and the butt end, a center of gravity of the shaft located with a distance LG from the tip end, a ratio of the distance LG to the whole length LS being in a range of from 0.54 to 0.65, a butt end portion which has a length of 300 mm from the butt end toward the tip end, the butt end portion including fibers including a low elastic fiber having an elastic modulus in a range of from 5 to 20 t/mm$^2$, and a high elastic fiber having an elastic modulus greater than 20 t/mm$^2$ and not more than 50 t/mm$^2$.

9 Claims, 5 Drawing Sheets

GOLF CLUB SHAFT AND GOLF CLUB USING THE SAME

BACKGROUND OF THE INVENTION

1. Field of the Invention

The present invention relates to a golf club shaft and a golf club using the same to improve flight distance of hit ball.

2. Description of the Related Art

In recent years, to hold fair golf competitions, significant progress of flight distance of hit ball is restrained on the golf rule by controlling spring effect of a golf club head, a length of a golf club or moment of inertia of a golf club head. In such a circumstance, to improve flight distance of hit ball, JP2004-201911A1 proposed a golf club with a shaft as long as possible in a range of rule, for example. Such golf club provides golfers with high head speeds using the longest club shaft.

However, such golf club with a long shaft tends to hit a ball at the outside the sweet spot of the club face due to the difficulty of control of the club head. Namely, smash-factor which is a ratio of a hit ball velocity to a club head velocity may decrease. Accordingly, it was difficult to improve flight distance of hit ball using the conventional golf club.

To solve the problem above, a golf club which has a club head with a weight greater than conventional club head and a club shaft with a short length is proposed. Such golf club makes the smash-factor improve, and a released ball velocity from the club face of the golf club can be faster. Since the golf club tends to have a large moment of inertia, it is difficult to swing the golf club, and thereby the swing feeling tends to deteriorated.

It is an object of the present invention to provide a golf club shaft and a golf club using the same to improve flight distance of hit ball while keeping a better feeling of a golf swing.

SUMMARY OF THE INVENTION

In accordance with the present invention, there is provided a golf club shaft extending from a tip end to a butt end and made of fiber reinforced resin, comprising a weight being in a range of from 30 to 55 g, a whole length LS between the tip end and the butt end, a center of gravity of the shaft located with a distance LG from the tip end, a ratio of the distance LG to the whole length LS being in a range of from 0.54 to 0.65, a butt end portion which has a length of 300 mm from the butt end toward the tip end, the butt end portion including fibers including a low elastic fiber having an elastic modulus in a range of from 5 to 20 t/mm$^2$, and a high elastic fiber having an elastic modulus greater than 20 t/mm$^2$ and not more than 50 t/mm$^2$, and said fibers in the butt end portion comprising, in weight, the low elastic fiber of from 20 to 30% and the high elastic fiber of from 80 to 70%.

DETAILED DESCRIPTION

An embodiment of the present invention will be explained below with reference to the accompanying drawings.

Figure 1:
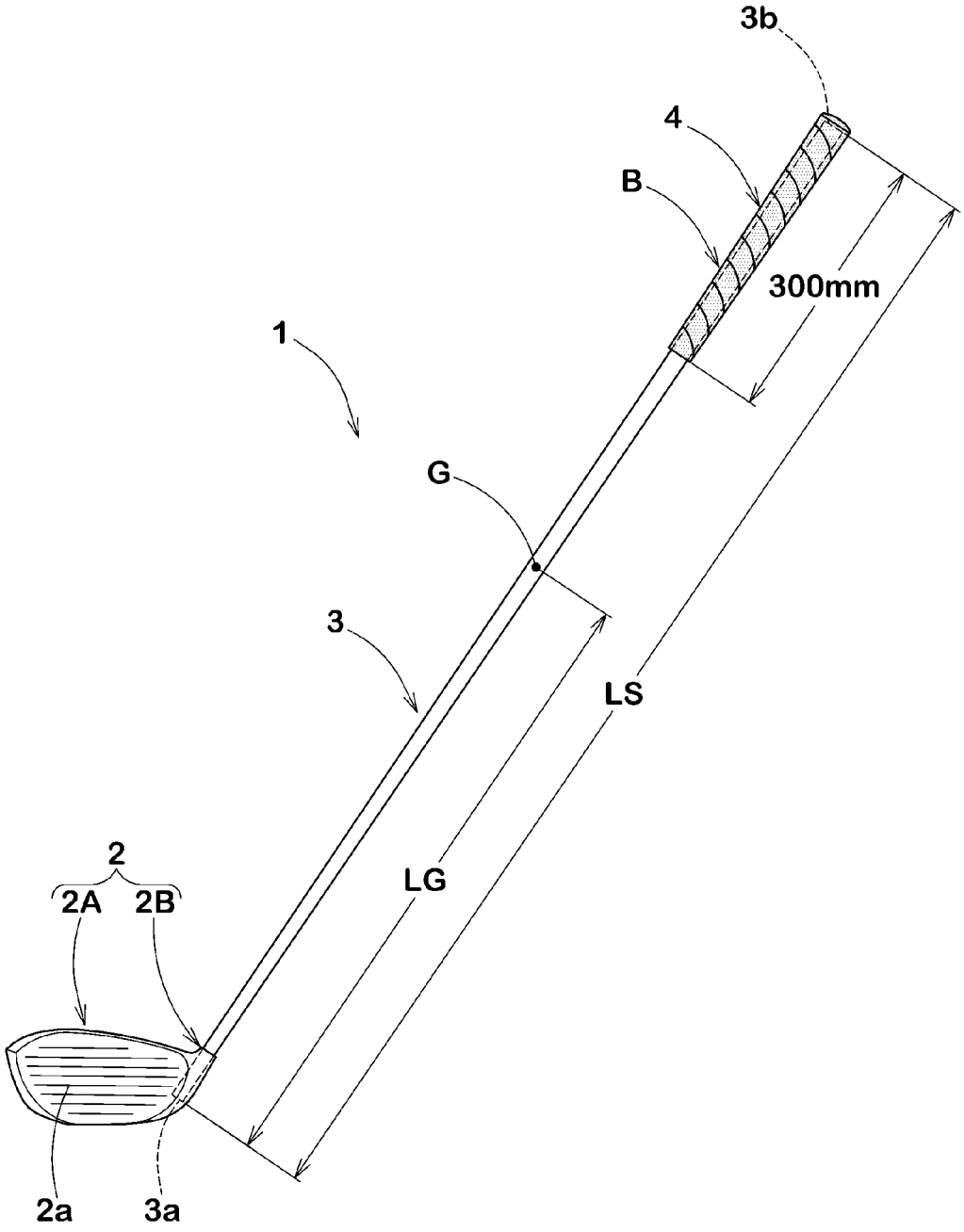
FIG. 1 is a front view of a golf club showing an embodiment of the present invention.

FIG. 1 shows a front view of a golf club 1 according to an embodiment of the present invention. The golf club 1 comprises a golf club head 2, a golf club shaft (hereinafter referred simply as "shaft") 3 and a grip 4.

It is not particularly limited, the golf club head 2 has a preferably weight not more than 290 g, more preferably not more than 287 g, further preferably not more than 284 g, preferably not less than 270 g, and more preferably not less than 273 g. if the weight of the club head 2 is too large, the club head speed may not be improved due to the difficulty of a golf swing. On the other hand, if the weight of the club head 2 is too small, the durability of the club head tends to deteriorated due to decrease of strength of the club head.

Although the club length of the golf club 1 is not particularly limited, the length is preferably set not less than 44.0 inches, more preferably not less than 44.5 inches and further preferably not less than 45.0 inches, and preferably set not more than 47.0 inches, more preferably not more than 46.5 inches, and further preferably not more than 46.0 inches. A golf club with such a club length provides golfers with a good swing balance and a high swing speed based on the length.

Here, the club length is measured based on the golf rule of "Option c. Length" of "Appendix II—Design of clubs" issued by the Royal and Ancient Golf Club of Saint Andrews (R&A).

The golf club head 2 is, for example, a wood-type golf club head which comprises: a hollowed main body 2A with a clubface 2*a* for hitting a ball; and a hosel portion 2B formed as a tubular body on a heel side of the main body 2A to which a tip end 3*a* of the club shaft 3 to be inserted. As for the club head 2, not only the wood-type club head, but also iron-type and utility-type club heads can be employed.

The club head 2 is produced from one or more kinds of metallic materials. Preferable examples of the metallic materials are, for instance, pure titanium, titanium alloy, stainless steel, maraging steel, soft iron and combinations of these metals. Further, although not shown in the drawings, non-metallic materials with a lower specific gravity such as fiber reinforced resin may be used in a part of the club head 2. To shift a center of gravity of the club head toward the bottom side, for example, the club head 2 preferably has an upper portion made of a CFRP member at least partially, and a bottom portion made of a titanium alloy at least partially.

The club head 2 preferably has a weight not less than 185 g, more preferably not less than 192 g, not more than 210 g, preferably not more than 206 g, and further preferably not more than 203 g. such a golf club head 2 with the weight provides golfers with a good swing balance and can transmit a large kinetic energy to a hit ball.

In a suitable embodiment, a ratio of the club head weight to the golf club weight (club head weight/golf club weigh) is set not less than 0.670, more preferably not less than 0.675, and more preferably not less than 0.680, and is preferably set not more than 0.720 and more preferably not more than 0.715. Such golf club 1 with the ratio provides golfers with a good swing balance and can transmit a large kinetic energy to a hit ball.

The grip 4 is made of a rubber compound which includes, for example, a natural rubber, oil, a carbon black, sulfur and an oxide of zinc. The rubber compound is kneaded, and vulcanized to form the predetermined grip shape. The weight of the grip 4 is preferably set in the range of from 27 to 45 g, in order to maintain the strength, the durability and easy golf swing.

The club shaft 3 has the tip end 3*a* to be attached to the hosel portion 2B of the club head 2, and a butt end 3*b* attached to the grip 4. Namely, the tip end 3*a* of the club shaft 3 is located in interior of the club head 2, and the butt end 3*b* is located inside the grip 4. As shown in FIG. 1, reference symbol "G" shows a center of gravity of the club shaft 2. The center of gravity G of the club shaft 3 is located on the shaft center line. Moreover, the club shaft 3 in this embodiment includes a tapered tubular body with a circular section and extends from the butt end 3*b* toward the tip end 3*a* while decreasing the outer diameter.

The club shaft 3 in this embodiment is made of fiber reinforced resin including reinforcing fibers and a matrix resin to fix the reinforcing fibers dipped therein. Such club shaft 3 made of fiber reinforced resin has a light weight as compared to a steel shaft, and a design flexibility to adjust the flexural rigidity thereof. The club shaft 3 is manufactured by a sheet winding method using a prepreg which is a sheet body of reinforcing fibers impregnated with a heat-hardening resin, for example. Therefore, the club shaft 3 has the tubular body including a plurality of plies of reinforcing fibers. As shown in FIG. 1, the club shaft 3 has a whole length LS between the tip end 3*a* and the butt end 3*b*, and a distance LG from the tip end 3*a* to the center of gravity G of the club shaft 3.

The club shaft 3 has a weight Ws in a range of from 30 g to 55 g. if the weight Ws of the club shaft 3 is too small, strength of the club shaft 3 tends to be deteriorated due to decreasing the thickness of the shaft 3 to keep a certain necessary length. From this point of view, the weight Ws of the club shaft 3 is set at least 30 g, more preferably not less than 32 g, and more preferably not less than 34 g. on the other hand, if the weight Ws of the club shaft 3 is greater than 55 g, the swing speeds of the golf club 1 using such shaft 3 may be decreased. From this point of view, the weight Ws of the club shaft 3 is set at most 55 g, preferably not more than 54 g, and more preferably not more than 53 g.

The club shaft 3 has a ratio LG/LS of the distance LG to the whole length LS being in a range of from 0.54 to 0.65. Namely, the club shaft 3 according to the present invention has the center of gravity G of the shaft 3 shifted toward the butt end 3*b*. Such golf club shaft 3 and the golf club 1 using the same can obtain the suitable moment of inertia of the golf club providing golfers with easy operation due to the specified weight and the specified weight balance. Accordingly, golfers who use the club shaft 3 according to the present invention can easily perform a golf swing that they want. Moreover, the smash factor may be improved and thereby flight distance of hit ball may be increased, when the whole length LS is set as a short length.

If the ratio LG/LS is less than 0.54, the center of gravity G of the club shaft 3 may be close to the tip end 3*a*, and thereby a club head in light weight may be required to maintain the swing balance of the golf club well for such golf club shaft. Usually, the club head with a light weight has an undesirable small moment of inertia, and decreases the smash factor. From this point of view, the ratio LG/LS is preferably set not less than 0.55, and more preferably not less than 0.56.

On the other hand, if the ratio LG/LS is greater than 0.65, the center of gravity G of the club shaft 3 may be significantly close to the butt end 3*b*, and thereby a heavy club head may be required to maintain the swing balance of the golf club well for such golf club shaft, and such club shaft tends to have undesirable decreased strength on the side of the tip end 3*a*. From this point of view, the ratio LG/LS is preferably set not more than 0.64, and more preferably not more than 0.63.

The whole length LS of the club shaft 3 is not particularly limited. However, if the whole length LS is too small, a radius of swing of the golf club may be small, and thereby it is difficult to improve the swing speed of golf club. On the other hand, if the whole length LS is too large, the moment of inertia of the golf club 1 tends to be large, and thereby it may be difficult to perform a golf swing. From this point of view, the whole length LS of the club shaft 3 is preferably set not less than 105 cm, more preferably not less than 107 cm, and further preferably not less than 110 cm. Moreover, the whole length LS of the club shaft 3 is preferably set not more than 120 cm, more preferably not more than 118 cm, and further preferably not more than 116 cm.

In order to shift the position of the center of gravity G of the club shaft, the thickness and/or the taper angle of the club shaft in the axial direction may be changed, for example. These adjustments can be done by changing the winding times of prepreg sheets (see below), for example.

The club shaft 3 has a butt end portion B which has a length of 300 mm from the butt end 3*b* toward the tip end 3*a*. The butt end portion B includes reinforcing fibers including a low elastic fiber with an elastic modulus in a range of from 5 to 20 t/mm$^2$, and a high elastic fiber with an elastic modulus greater than 20 t/mm$^2$ and not more than 50 t/mm$^2$. Moreover, reinforcing fibers of the butt end portion B comprise, in weight, the low elastic fibers of from 20 to 30% and the high elastic fibers of from 80 to 70%.

The club shaft 3 with the butt end portion B including the low elastic fibers of 20 to 30% in weight, can be prevented a significant increase of the flexural rigidity in the butt end portion B. Accordingly, the swing feeling of the golf club with such club shaft may be improved due to the flexibility of the butt end portion B. Moreover, during a golf swing using the club shaft 3 according to the present invention, the butt-end portion B of the club shaft 3 can be sufficiently bent so as to increase the club head velocity, and thereby flight distance of hit ball can be increased. Therefore, the club shaft 3 and the golf club 1 using the shaft 3 of the present invention can be improved flight distance of hit ball while keeping the better swing feeling.

The butt end portion B is a portion which is gripped by golfers, and therefore, the flexural rigidity of such butt end portion B is clearly important to improve the swing feeling and the club head velocity.

In the present invention, the low elastic fibers are included from 20 to 30% in weight of whole fibers of the butt end portion B. If the content of low elastic fibers in whole fibers in the butt end portion B is less than 20% in weight, the flexural rigidity of the butt end portion B tends to increase, and thereby the swing feeling of the shaft may be deteriorated. On the other hand, if the content of low elastic fibers is more than 30% in weight, the flexural rigidity of the butt end portion B significantly decreases, and thereby the durability of the club shaft 3 may be deteriorated. From this point of view, the content of low elastic fibers in whole fibers of the butt end portion B is preferably set not less than 21%, more preferably not less than 22%, preferably not more than 29%, and more preferably not more than 28%.

Here, the lower limit of the elastic modulus of low elastic fibers is 5 t/mm$^2$ to maintain the strength of the club shaft 3.

The high elastic fibers are included from 80 to 70% in weight of whole fibers of the butt end portion B. If the content of high elastic fibers in whole fibers in the butt end portion B is less than 70% in weight, the flexural rigidity of the butt end portion B tends to decrease, and thereby the durability of the club shaft 3 may be deteriorated. On the other hand, if the content of high elastic fibers is more than 80% in weight, the flexural rigidity of the butt end portion B increase, and thereby the swing feeling of the shaft may be deteriorated. From this point of view, the content of high elastic fibers in whole fibers of the butt end portion B is preferably not less than 71%, more preferably not less than 72%, preferably not more than 79%, and more preferably not more than 78%.

Here, the upper limit of the elastic modulus of high elastic fibers is 50 t/mm$^2$ to prevent significant increase of flexural rigidity and torsional stiffness, and to obtain suitable flexural rigidity and strength of the club shaft 3.

In the preferably aspect of the present invention, reinforcing fibers included in the butt end portion B comprise bias fibers inclined at an angle with respect to the axial direction of the shaft. The club shaft 3 with such bias fibers has an improved torsional stiffness and strength.

Bias fibers of the butt end portion B preferably include two kinds of fibers which extend in opposite directions each other. Angles of bias fibers with respect to the axial direction of the shaft are preferably not less than 15 degrees, more preferably not less than 25 degrees, and further preferably not less than 40 degrees. Moreover, angles of the bias fibers are preferably not more than 60 degrees, more preferably not more than 50 degrees, and are further preferably 45 degrees.

In the preferably aspect of the present invention, bias fibers in the butt end portion B is preferably included in a range of from 15 to 25% in weight of whole fibers of the butt end portion B. If the content of bias fibers is less than 15% in weight in the butt end portion B, the torsional stiffness and strength may be decreased. With this, the content of bias fibers in the butt end portion B is preferably not less than 16% in weight, and more preferably not less than 17%. On the other hand, if the content of bias fibers is more than 25% in weight in the butt end portion B, the torsional stiffness and strength may be significantly increased, and thereby the swing feeling tends to deteriorated. With this, the content of bias fibers in the butt end portion B is preferably not more than 24% in weight, and more preferably not less than 23% of whole fibers of the butt end portion B.

As for bias fibers, the high elastic fibers are preferably employed. Especially, the elastic modulus of bias fibers is preferably not less than 30 t/mm$^2$, and more preferably not less than 35 t/mm$^2$. Such bias fibers with high elastic modulus improve the torsional stiffness and strength of the shaft, and thereby the flight direction of hit ball can be stable and durability of the shaft 3 also improves.

In the preferable aspect of the present invention, the low elastic fibers extend in substantially parallel with the axial direction of the club shaft 3 which means that angles of low elastic fibers with respect to the axial direction are 0 degree plus/minus 5 degrees.

It is not particularly limited, the club shaft 3 according the present embodiment preferably has a torque value of from 5.0 to 8.0 degrees.

Figure 2:
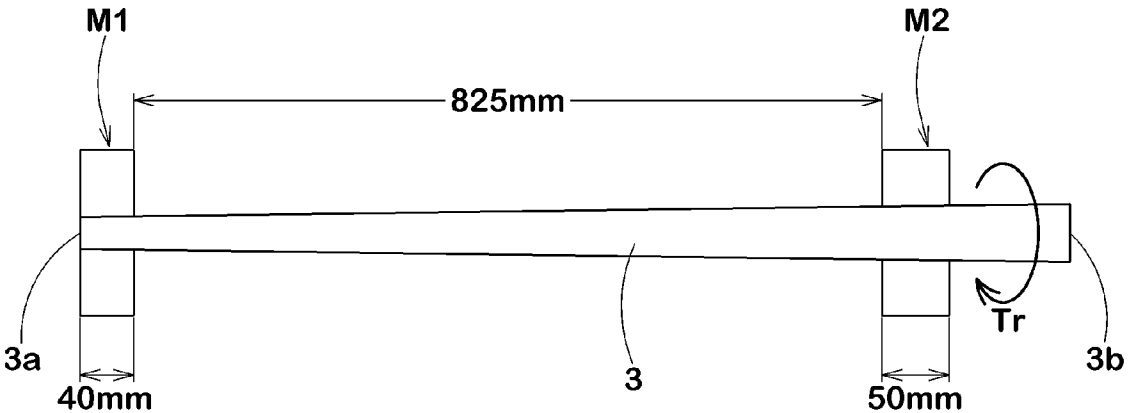
FIG. 2 is a side view explaining of a method for measurement of a torque value of a golf club shaft.

As shown in FIG. 2, the torque value of the club shaft 3 is measured as a torsional angle (degree) of the club shaft under a measurement state that the tip end 3*a* of the club shaft 3 is fixed on un-rotation state using the first jig M1 with a width of 40 mm, the position at 825 mm from the first jig M1 in the axial direction of the club shaft 3 is chucked using the second jig M2 with a width of 50 mm, and then the second jig M2 is given a torque Tr of 13.9 kgf cm to twist the club shaft 3. Here, angular velocity for applying the torque Tr is not more than 130 degrees/minute, and the first and second jigs M1 and M2 are pneumatic chucks with holding pressures of 2.0 kgf/cm$^2$ and 1.5 kgf/cm$^2$, respectively.

When the torque value of the club shaft 3 in the golf club is less than 5.0 degrees, the club head 2 tends to not sufficiently go back to the address state during a golf swing from a take back to the down swing, and thereby the directivity of hit balls and the swing feeling may deteriorate. From this point of view, the torque value of the club shaft 3 is preferably not less than 5.1 degrees, and more preferably not less than 5.2 degrees. While, on the other hand, when the torque value of the club shaft 3 is greater than 8.0 degrees, the behavior of the club head 2 tends to be unstable during a golf swing, and thereby directivity of hit balls may deteriorate as hitting points on the club face widely dispersed. From this point of view, the torque value of the club shaft 3 is preferably not more than 7.9 degrees, and more preferably not more than 7.8 degrees.

The club shaft 3 has a torsional stiffness at a position P1 of 150 mm length from the butt end 3*b* thereof being not more than 2.5 kgfm$^2$.

Figure 3:
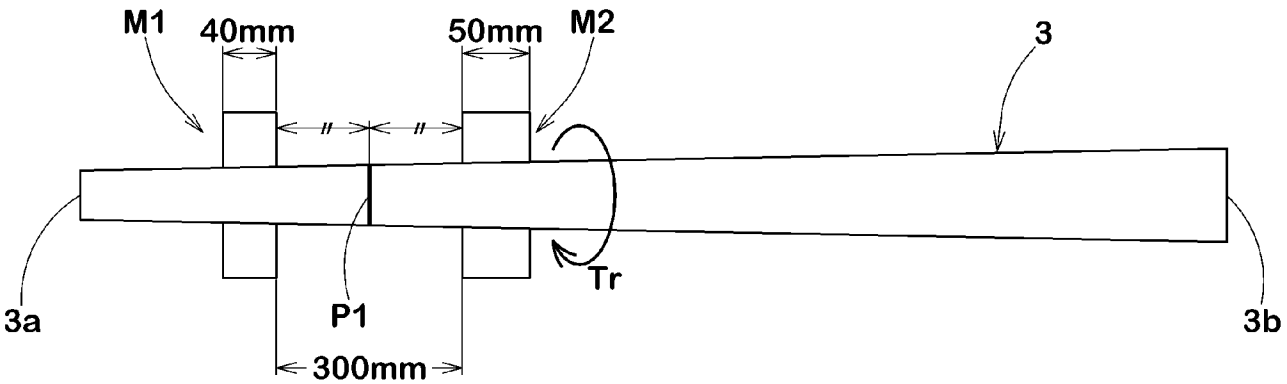
FIG. 3 is a side view explaining of a method for measurement of torsional stiffness of a golf club shaft.

As shown in FIG. 3, the torsional stiffness GI is measured as a torsional angle θ of the club shaft 3 under a state that the club shaft 3 is chucked by the first jig M1 and the second jig M2 such that the position P1 of the club shaft 3 is located at the center of the axial distance between the first and the second jigs M1 and M2, and the second jig M2 is given a torque Tr of 13.9 kgf cm to twist the club shaft 3. Moreover, the torsional stiffness GI is calculated as following relation:

$$GI=Tr/(\theta/L).$$

Here, "θ" is a torsional angle (rad) of the club shaft, and "L" is the axial distance between the first and the second jigs M1 and M2 which is 200 mm in this embodiment. The widths and the holding pressures of the first and second jigs M1 and M2 are the same in the torque measurement condition.

When the torsional stiffness GI at the position P1 of the club shaft 3 is greater than 2.5 kgfm$^2$, the club head 2 tends to not sufficiently go back to the address state during a golf swing from a take back to the down swing, and thereby the directivity of hit balls and the swing feeling may deteriorate. From this point of view, the torsional stiffness GI at the position P1 of the club shaft 3 is preferably not more than 2.4 kgfm$^2$, and more preferably not more than 2.3 kgfm$^2$. On the other hand, when the torsional stiffness GI at the position P1 of the club shaft 3 is too small, the behavior of the club head 2 tends to be unstable during a golf swing, and thereby directivity of hit balls may deteriorate as hitting points on the club face widely dispersed. From this point of view, the torsional stiffness GI is preferably not less than 1.0 kgfm$^2$, more preferably not less than 1.2 kgfm$^2$, and more preferably not less than 1.3 kgfm$^2$.

The club shaft 3 is preferably produced by so-called a sheet winding method using a prepreg sheet. In this embodiment, as for the prepreg sheet, an UD-prepreg sheet with fibers each oriented substantially in one direction may be employed in the method. The term "UD" stands for uni-direction. However, prepreg sheets other than the UD prepreg may be used. For example, a cloth-prepreg with woven fibers may be used.

The prepreg sheet has a fiber such as carbon fiber and a matrix resin such as a thermosetting resin including an epoxy resin, for example. In a state of the prepreg, the matrix resin is in a non cured state including a semicured state. The shaft 3 is produced by winding prepreg sheets around a mandrel with a diameter equal to the inner diameter of the club shaft 3 and curing them. This curing is attained by heating.

As for the prepreg sheet, various products commercially available may be used. Table 1 shows some products of prepreg sheets.

TABLE 1

| Manufacturers | Prepreg sheet Number | Thickness (mm) | Fiber content (mass %) | Resin content (mass %) | Fiber Spec. Fiber Kinds | Elastic modulus* ($t/mm^2$) | Tensile strength* ($kgf/mm^2$) |
|---|---|---|---|---|---|---|---|
| Toray Industries, Inc. | 3255S-10 | 0.082 | 76 | 24 | T700S | 23.5 | 500 |
| Toray Industries, Inc. | 3255S-12 | 0.103 | 76 | 24 | T700S | 23.5 | 500 |
| Toray Industries, Inc. | 3255S-15 | 0.123 | 76 | 24 | T700S | 23.5 | 500 |
| Toray Industries, Inc. | 805S-3 | 0.034 | 60 | 40 | M30S | 30 | 560 |
| Toray Industries, Inc. | 2255S-10 | 0.082 | 76 | 24 | T800S | 30 | 600 |
| Toray Industries, Inc. | 2255S-12 | 0.102 | 76 | 24 | T800S | 30 | 600 |
| Toray Industries, Inc. | 2255S-15 | 0.123 | 76 | 24 | T800S | 30 | 600 |
| Toray Industries, Inc. | 2256S-10 | 0.077 | 80 | 20 | T800S | 30 | 600 |
| Toray Industries, Inc. | 2256S-12 | 0.103 | 80 | 20 | T800S | 30 | 600 |
| Nippon Graphite Fiber Cop. | E1026A-09N | 0.100 | 63 | 37 | XN-10 | 10 | 190 |
| Mitsubishi Rayon Co. Ltd. | TR350C-100S | 0.083 | 75 | 25 | TR50S | 24 | 500 |
| Mitsubishi Rayon Co. Ltd. | TR350C-125S | 0.104 | 75 | 25 | TR50S | 24 | 500 |
| Mitsubishi Rayon Co. Ltd. | TR350C-150S | 0.124 | 75 | 25 | TR50S | 24 | 500 |
| Mitsubishi Rayon Co. Ltd. | MR350C-075S | 0.063 | 75 | 25 | MR40 | 30 | 450 |
| Mitsubishi Rayon Co. Ltd. | MR350C-100S | 0.085 | 75 | 25 | MR40 | 30 | 450 |
| Mitsubishi Rayon Co. Ltd. | MR350C-125S | 0.105 | 75 | 25 | MR40 | 30 | 450 |
| Mitsubishi Rayon Co. Ltd. | MR350E-100S | 0.093 | 70 | 30 | MR40 | 30 | 450 |
| Mitsubishi Rayon Co. Ltd. | HRX350C-075S | 0.057 | 75 | 25 | HR40 | 40 | 450 |
| Mitsubishi Rayon Co. Ltd. | HRX350C-110S | 0.082 | 75 | 25 | HR40 | 40 | 450 |

*Values of the tensile strength and the elastic modulus are measured based on "Testing methods for carbon fibers" specified on JIS R7601: 1986.

Figure 4:
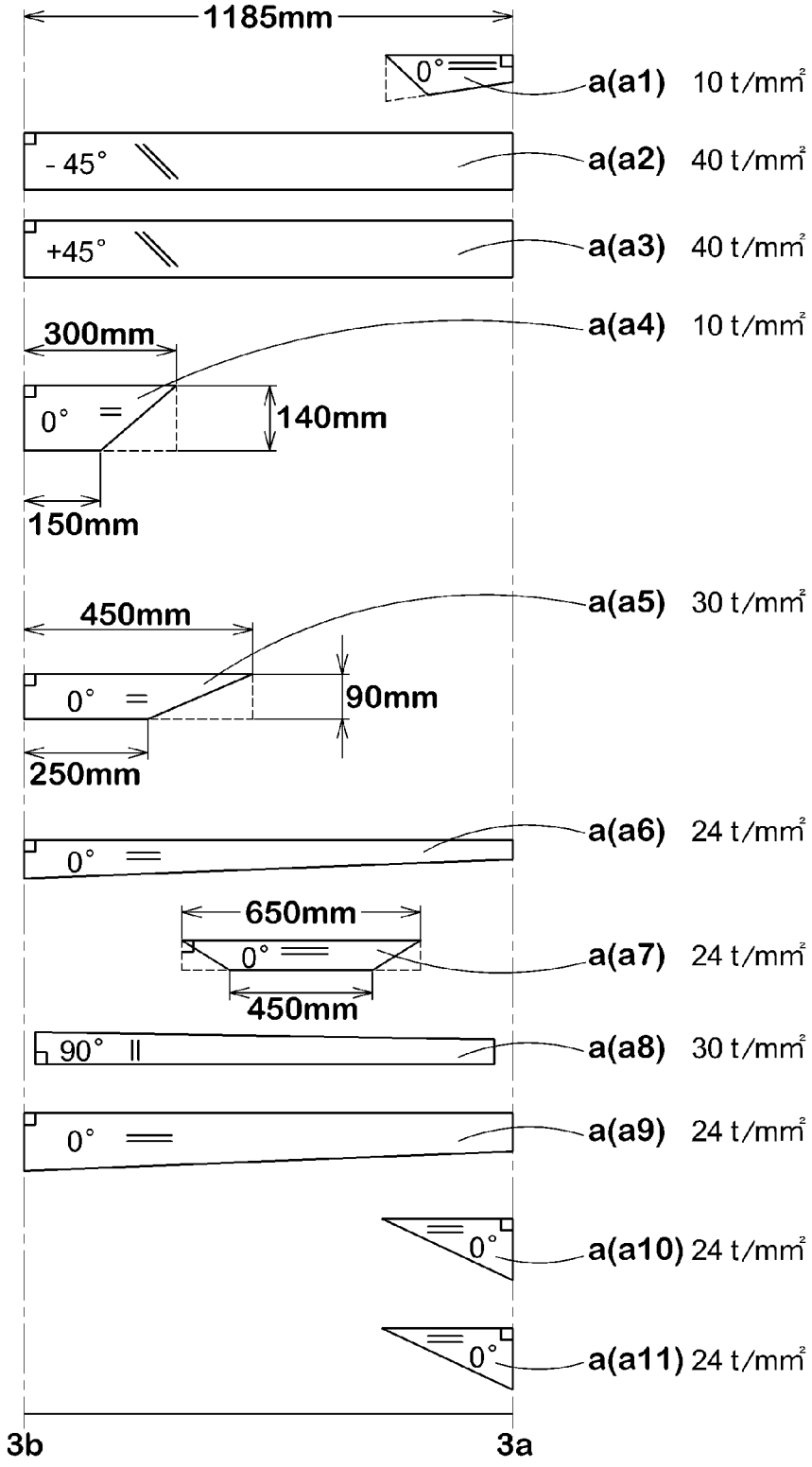
FIG. 4 is a development view of prepreg sheets included in a golf club shaft.

FIG. 4 shows a development view (sheet constitution view) of prepreg sheets which compose of the club shaft 3 according to one embodiment of the present invention. The club shaft 3 comprises a plurality of prepreg sheets (a). In the present application, the development view as shown in FIG. 4 shows the sheets constituting the shaft in order from the radially inner side of the shaft. The prepreg sheets are wound around the mandrel in order from the sheets located above in the development view. In the development view of FIG. 4, the horizontal direction of the figure corresponds with the axial direction of the club shaft, wherein the right side of the figure corresponds to the tip end 3*a* side, and the left side of the figure corresponds to the butt end 3*b* side of the club shaft, respectively. Also, each elastic modulus of fibers included in each prepreg sheet is shown in FIG. 4.

Prepreg sheets according to one embodiment of the present invention comprise a straight sheet, a bias sheet and a hoop sheet.

The straight sheet has a reinforcing fiber oriented at an angle of substantially 0 degree with respect to the axial direction of the club shaft. Here, "substantially 0 degree" of the fiber means that the fiber has an oriented angle of within plus/minus 10 degrees with respect to the axial direction of the club shaft, and preferably has the oriented angle of within plus/minus 5 degrees with respect to the axial direction of the club shaft. After curing the straight prepreg, the oriented angle of reinforcing fiber in the straight sheet is maintained in the range of the angle above. In this embodiment, each sheet a1, a4, a5, a6, a7, a9, a10 and all is formed as the straight sheet. These straight sheets are highly correlated with the flexural rigidity and strength of the shaft, and therefore, a main portion of the club shaft 3 is composed of straight sheets.

The bias sheet has a reinforcing fiber oriented at a certain angle with respect to the axial direction of the club shaft. Therefore, the bias fiber described above is comprised of the reinforcing fiber in the bias sheet after curing. In this embodiment, each sheet a2 and a3 is formed as the bias sheet. The bias sheet a2 has a reinforcing fiber oriented at angle of minus 45 degrees, and the bias sheet a3 has a reinforcing fiber oriented at angle of plus 45 degrees with respect to the axial direction of the shaft. Namely the bias sheets a2 and a3 have reinforcing fibers oriented at the same angles with in the opposite direction to each other. Such pair of bias sheets are preferably provided in order to enhance the torsional rigidity and strength of the club shaft due to fibers oriented in opposite directions. Also, a pair of bias sheets can reduce anisotropy of strength of the club shaft.

The hoop sheet has a reinforcing fiber oriented at an angle of substantially 90 degrees with respect to the axial direction of the club shaft. The sheet a8 is the hoop sheet. Here, "substantially 90 degrees" of the fiber means that the fiber has an oriented angle of 90 degrees plus/minus 10 degrees with respect to the axial direction of the club shaft.

The hoop sheet is provided in order to enhance the crushing rigidity and strength of the club shaft 3. The crushing rigidity and strength are rigidity and strength against a force crushing the club shaft toward the inner side in the radial direction thereof. The crushing strength can be interlocked with flexural deformation to generate crushing deformation. In a particularly thin lightweight shaft, this interlocking property is large. The enhancement of the crushing strength also causes the enhancement of the flexural rigidity.

Each prepreg sheet is sandwiched between cover sheets before use in winding. The cover sheets comprise a release paper stuck on one surface of the prepreg sheet and a resin film stuck on the other surface of the prepreg sheet. The release paper has a bending stiffness greater than that of the resin film. Hereinafter, the surface on which the release paper is stuck is referred to as "a surface of a release paper side", and the surface on which the resin film is stuck is referred to as "a surface of a film side". Also, in the development view of FIG. 4, the surface of the film side is the front side. Namely, in the development view of FIG. 4, the front side of the figure is the surface of the film side of the prepreg sheet, and the back side of the figure is the surface of the release paper side of the prepreg sheet.

In the state of FIG. 4, the fibrous oriented direction of the sheet a2 is the same as that of the sheet a3. However, in the state of the laminating thereof to be described later, the sheet a3 is reversed, and thereby the fibrous directions of the sheets a2 and a3 are opposite to each other. In light of this point, in FIG. 4, the fibrous direction of the sheet a2 is described as "−45 degrees", and the fibrous direction of the sheet a3 is described as "+45 degrees".

In order to wind the prepreg sheet (a) around the mandrel, the resin film being stuck thereon is removed from the prepreg sheet (a). By removing the resin film, the surface of the film side which has stickiness due to uncured matrix resin is exposed. Next, the sticky edge portion in the surface of the film side of the prepregs sheet (a) is attached onto the mandrel, and then, the prepregs sheet (a) is wound around the mandrel by rotating the mandrel while removing the release paper from the prepregs sheet (a).

In the winding step of prepregs sheets above, since the release paper supports prepreg sheets and improves its bending resistance, creases on prepreg sheets during winding can be prevented. Accordingly, by winding prepregs sheets based on the step above, failures such as creases occurred in the edge of prepregs sheets may be prevented, and thereby the quality of the club shaft can be improved.

Figure 5:
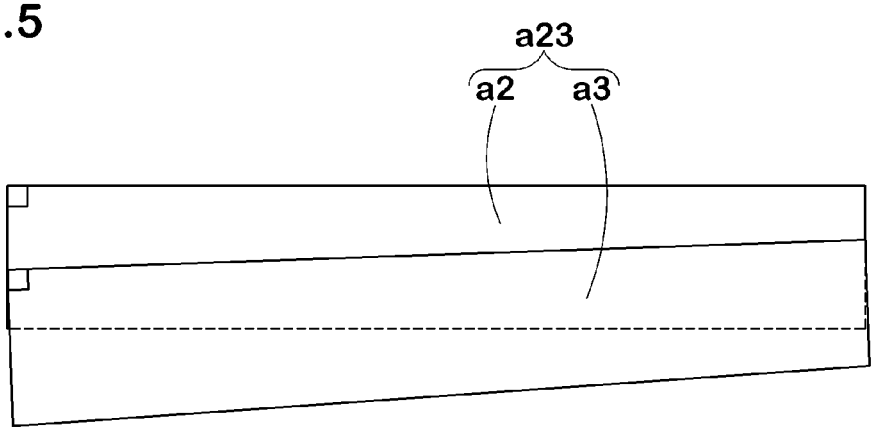
FIG. 5 is a plan view of a first laminated prepreg sheets.
Figure 6:
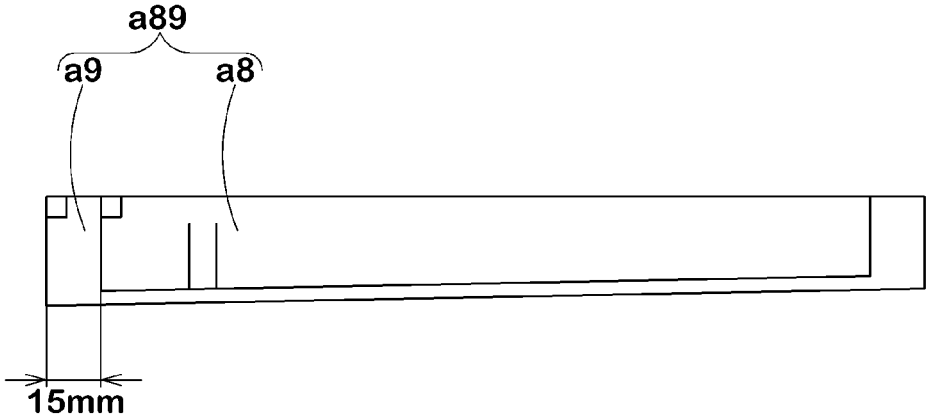
FIG. 6 is a plan view of a second laminated prepreg sheets.

A combination prepreg sheets which is piled at least two prepreg sheets before winding on the mandrel may be preferably employed. In this embodiment, two types of combination prepreg sheets are employed as shown in FIGS. 5 and 6. FIG. 5 shows the first combination sheet a23 which combines two bias sheets a2 and a3 each other. FIG. 6 shows the second combination sheet a89 which combines the hoop sheet a8 and the straight sheet a9 each other.

The first combination sheet a23 shown in FIG. 5 is produced using the steps of: reversing the bias sheet a3; and attaching the reversed bias sheet a3 onto the bias sheet a2. In this embodiment, as shown in FIG. 5, the edge of the butt end side of the bias sheet a3 is located a distance of 24 mm from the upper edge of the bias sheet a2, and the edge of the tip end side of the bias sheet a3 is located a distance of 10 mm from the upper edge of the bias sheet a2. Namely, each upper edge of bias sheets a2 and a3 are not parallel with each other.

In the first combination sheet a23, a circumferentially difference between the bias sheets a2 and a3 corresponds to a circumference angle of about 180 degrees plus/minus 15 degrees with respect to the club shaft cured. Such first combination sheet a23 is useful to disperse ends of reinforcing fibers in each prepreg sheet, and thereby the uniformity of the shaft along the circumferential direction is improved.

As shown in FIG. 6, the upper edges of hoop sheet a8 and straight sheet a9 are consistent with each other in the second combination sheet a89. Also, both the edges of tip end side and butt end side of the hoop sheet a8 are located inside from the straight sheet a9. In this embodiment, the difference between edges of the hoop and straight sheets a8 and a9 in each side is about 15 mm, as shown in FIG. 6. Accordingly, the hoop sheet a8 is fully supported on the straight sheet a9. Basically, winding the hoop sheet a8 which has reinforcing fibers laid at high angles with respect to the axial direction onto the mandrel is difficult. However, such combination sheet a89 in which the hoop sheet a8 is fully supported on the straight sheet a9 is easy to wind onto the mandrel, and thereby failures in winding hoop sheets a8 are prevented.

Next, the producing method of the shaft 3 using prepreg sheets (a) shown in FIG. 4 is described. The method according to the present embodiment includes the processes of: (1) Cutting process; (2) Laminating Process; (3) winding Process; (4) Tape Wrapping Process; (5) Curing Process; (6) Process of Extracting Mandrel and Process of Removing wrapping Tape; (7) Process of Cutting Both Ends; (8) Polishing Process; and (9) Coating Process.

(1) Cutting Process:

Each prepreg sheet a1 to all is prepared by cutting the original sheet body into a desired shape in the cutting process, as shown in FIG. 4.

(2) Laminating Process:

combination sheets a23 and a89 are prepared by combining a plurality of prepreg sheets together in the laminating process. To combine a plurality of prepreg sheets into one, heating and/or pressing processes may be employed. Suitable parameters such as the temperature in the heating process and/or the pressure in the pressing process may be selected in order to improve the adhesive strength of prepreg sheets.

(3) Winding Process:

The mandrel which is typically made of metallic material is employed in this process. The mandrel has an outer surface which is previously coated with parting agent and a resin (tacking resin) disposed outside the parting agent. The prepreg sheets (a) are wound around the mandrel respectively in the winding process. The tacking resin is useful for fixing the winding start edge of the prepreg sheet on the mandrel due to its stickiness. Each of the first and second combination sheets a23 and a89 is also wound as the combined state. After the winding process, a winding body which includes a plurality of wound prepreg sheets on the mandrel is obtained.

(4) Tape Wrapping Process:

A tape is wrapped around the outer peripheral surface of the winding body in the tape wrapping process. This tape is also referred to as a wrapping tape. This wrapping tape is wrapped with a tension to apply pressure to the winding body in order to discharge included air therein, and can prevent that a void is generated in the cured club shaft.

(5) Curing Process:

In the curing process, the winding body after performing the tape wrapping is heated. This heating cures the matrix resin to form a cured resin laminated body. In this curing process, the matrix resin fluidizes temporarily. This fluidization of the matrix resin can discharge air between prepreg sheets or in the sheet. The pressure applied from the wrapping tape accelerates this discharge of the air.

(6) Process of Extracting Mandrel and Process of Removing Wrapping Tape:

The process of extracting the mandrel and the process of removing the wrapping tape are performed after curing process. The order of the both processes is not limited. However, the process of removing the wrapping tape is preferably performed after the process of extracting the mandrel in light of enhancing the efficiency of the process of removing the wrapping tape.

(7) Process of Cutting Both Ends:

The both end parts of the cured laminate body are cut in this process. This cutting forms the tip end 3*a* and the butt end 3*b* of the shaft. This cutting flattens the end face of the tip end 3*a* and the end face of the butt end 3*b*.

(8) Polishing Process:

The surface of the cured laminate body is polished in this process. This polishing is also referred to as surface polishing. Spiral unevenness left behind as the trace of the wrapping tape may exist on the surface of the cured laminate body. The polishing extinguishes the unevenness as the trace of the wrapping tape to flatten the surface of the cured laminate body.

(9) Coating Process

The cured laminate body after the polishing process is subjected to coating.

The club shaft 3 is produced through the processes from 1 to 9 described above. The tip end 3*a* of the club shaft 3 is inserted and attached to the hosel portion 2B of the club head 2, and the grip 4 is attached onto the butt end 3*b* of the club shaft 3 to obtain the golf club 1.

Comparison Test

Golf clubs with club shafts based on Tables 2 to 5 are made and tested. All golf clubs have the same club heads made of titanium alloy with a volume of 460 $cm^3$.

All club shafts have the same lengths of 115 cm, and made in accordance with prepreg sheets with elastic modulus and shapes shown in FIG. 4 and Table 1. The low elastic fibers are employed carbon fibers with elastic modulus of 10 $t/mm^2$, and the high elastic fibers are employed carbon fibers with elastic modulus of 24, 30 and 45 $t/mm^2$, respectively. In the Example 1, these ratios of weight are 25% respectively.

Figure 8:
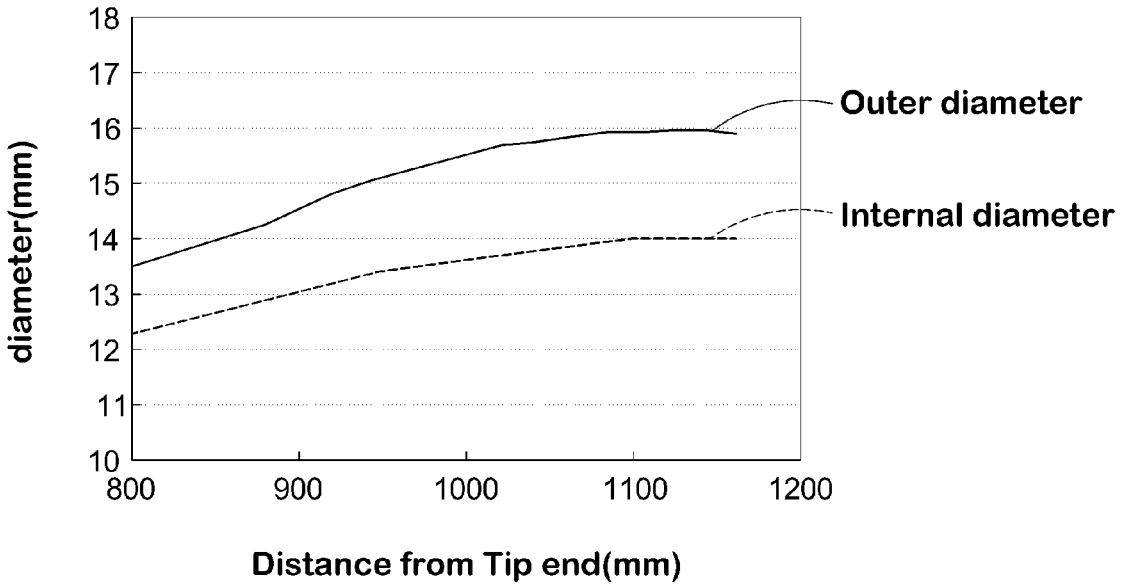
FIG. 8 is a graph showing distributions of internal and outer diameters of golf club shaft of an example.
Figure 9:
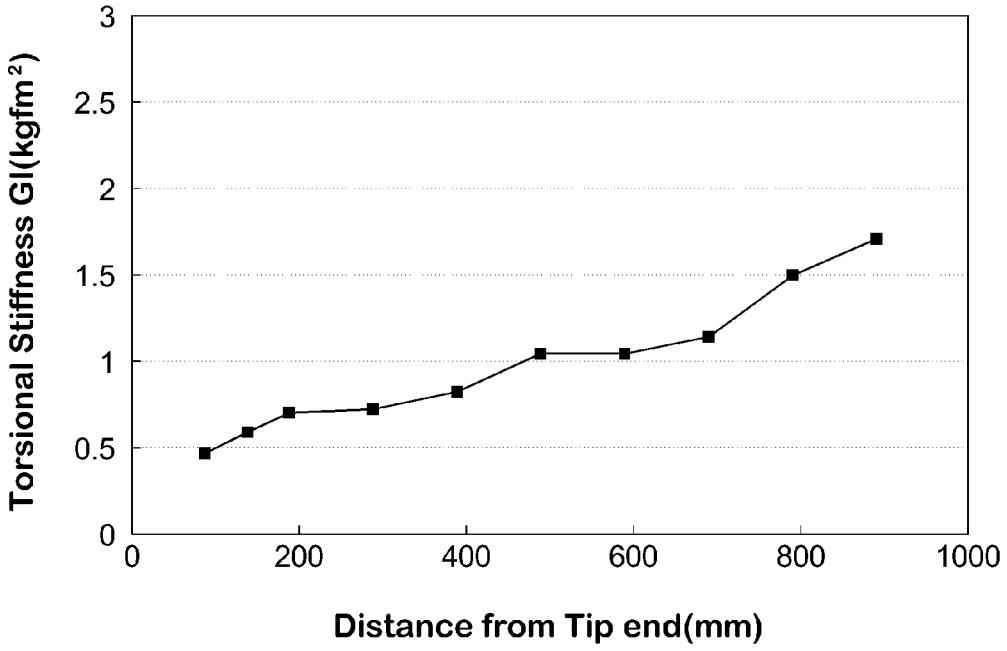
FIG. 9 is a graph showing a distribution of torsional stiffness GI of golf club shafts of an example.

The manufacturing method of each club shaft was as above-mentioned processes of 1 to 9. In each prepreg sheet a1 to all, the winding number of prepreg sheets, the thickness of prepreg sheets, the ratio of content of fibers in prepreg sheets, and elastic modulus of carbon fibers were suitably adjusted. The thickness of club shafts was modified in order to adjust the center of gravity of the club shaft. FIG. 8 is a graph showing the diameter of the club shaft of Example 2, and FIG. 9 is a graph showing the torsional stiffness of the club shaft of Example 2. The test methods were as follows.

Total Distance of Hit Ball:

The average total distance of five shots by a golfer with an average head velocity of 42 m/s was measured in each tested golf club. The larger the value is, the performance the better is.

Dispersion of Hit Balls:

In the test for the total distance of hit ball, the dispersion of hit balls in the right-and-left direction (the value was identified as a plus value in both directions) was measured in each tested golf club. The smaller the value, the performance the better is.

Figure 7:
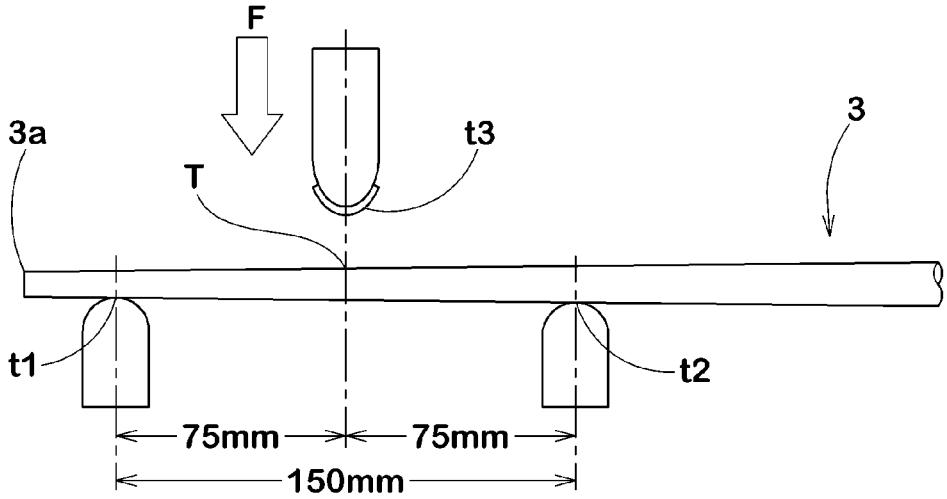
FIG. 7 is a side view explaining a method for measurement of "T-point strength" of a golf club shaft.

The Strength of Tip End Side of Club Shaft:

The strength of tip end side of club shaft (the strength of the T-point) is measured based on the shaft three-point flexural strength of SG mark method. The three-point flexural strength of the club shaft corresponds to the fracture strength of the shaft in SG type defined by the Consumer Product safety Association. FIG. 7 is an explanation view showing the measurement of the three-point flexural strength of the club shaft in SG mark method. In the method, the downward force F is applied at the position T of the club shaft 3 which is being supported at the positions t1 and t2. The position T is located with the center between the positions t1 and t2. The position T is set as the position at where the strength should be measured. In this embodiment, the position T is located with the distance of 90 mm from the tip end of the club shaft. In such a case, the span between the position t1 and t2 is set of 150 mm, and thereby the position t1 is located with the distance of 15 mm from the tip end 3*a* of the club shaft 3. Then, the peak force F when the club shaft 3 has been broken is measurement. The larger the value, the performance the better is.

The Strength of Butt End Side of Club Shaft:

The strength of butt end side of club shaft is measured at the position of 175 mm from the butt end of the club shaft based on the method of the strength of tip end side described above. The span between the position t1 and t2 is 300 mm. The larger the value, the performance the better is.

Feeling Test:

The feeling when the golfer had hit five balls was evaluated as four grades as follows.

4: very good

3: Good

2: Bad

1: worse

The results are shown in Tables 2 to 4.

TABLE 2

| | Ref. 1 | Ex. 1 | Ex. 2 | Ex. 3 | Ex. 4 | Ref. 2 |
|---|---|---|---|---|---|---|
| Ratio LG/LS | 0.52 | 0.54 | 0.56 | 0.63 | 0.65 | 0.66 |
| Content of low elastic modulus in butt end portion (Weight %) | 20 | 21 | 22 | 25 | 26 | 28 |
| Content of high elastic modulus in butt end portion (Weight %) | 80 | 79 | 78 | 75 | 74 | 73 |
| Content of bias fibers in butt end portion (Weight %) | 20 | 20 | 20 | 20 | 20 | 20 |
| Shaft weight (g) | 52 | 52 | 52 | 52 | 52 | 52 |
| Torque value (deg.) | 6 | 6 | 6 | 6 | 6 | 6 |
| Torsional stiffness GI at 150 mm position from butt end (kgf m) | 3.1 | 3.1 | 3.1 | 3.1 | 3.1 | 3.1 |
| Total distance of hit ball (yard) | 190 | 200 | 204 | 208 | 209 | 210 |
| Dispersion of hit ball (yard) | 15 | 15 | 15 | 15 | 15 | 15 |
| Strength of tip end side (T-point strength) (kgf) | 210 | 200 | 195 | 190 | 185 | 178 |
| Strength of butt end side (C-point strength) (kgf) | 82 | 84 | 85 | 86 | 87 | 88 |
| Feeling test (Four grades) | 3 | 3 | 4 | 4 | 3 | 3 |

TABLE 3

| | Ref. 3 | Ex. 5 | Ex. 2 | Ex. 6 | Ex. 7 | Ref. 4 |
|---|---|---|---|---|---|---|
| Ratio LG/LS | 0.56 | 0.56 | 0.56 | 0.56 | 0.56 | 0.56 |
| Content of low elastic modulus in butt end portion (Weight %) | 18 | 20 | 22 | 28 | 30 | 32 |
| Content of high elastic modulus in butt end portion (Weight %) | 82 | 80 | 78 | 72 | 70 | 68 |
| Content of bias fibers in butt end portion (Weight %) | 20 | 20 | 20 | 20 | 20 | 20 |
| Shaft weight (g) | 52 | 52 | 52 | 52 | 52 | 52 |

TABLE 3-continued

| | Ref. 3 | Ex. 5 | Ex. 2 | Ex. 6 | Ex. 7 | Ref. 4 |
|---|---|---|---|---|---|---|
| Torque value (deg.) | 6 | 6 | 6 | 6 | 6 | 6 |
| Torsional stiffness GI at 150 mm position from butt end (kgf m) | 3.1 | 3.1 | 3.1 | 3.1 | 3.1 | 3.1 |
| Total distance of hit ball (yard) | 202 | 203 | 204 | 208 | 209 | 210 |
| Dispersion of hit ball (yard) | 15 | 15 | 15 | 15 | 15 | 15 |
| Strength of tip end side (T-point strength) (kgf) | 195 | 195 | 195 | 190 | 185 | 178 |
| Strength of butt end side (C-point strength) (kgf) | 90 | 87 | 85 | 80 | 78 | 72 |
| Feeling test (Four grades) | 1 | 3 | 4 | 3 | 3 | 3 |

TABLE 4

| | Ref. 5 | Ex. 8 | Ex. 2 | Ex. 9 | Ex. 10 | Ref. 6 |
|---|---|---|---|---|---|---|
| Ratio LG/LS | 0.56 | 0.56 | 0.56 | 0.56 | 0.56 | 0.56 |
| Content of low elastic modulus in butt end portion (Weight %) | 22 | 22 | 22 | 22 | 22 | 22 |
| Content of high elastic modulus in butt end portion (Weight %) | 78 | 78 | 78 | 78 | 78 | 78 |
| Content of bias fibers in butt end portion (Weight %) | 20 | 20 | 20 | 20 | 20 | 20 |
| Shaft weight (g) | 28 | 34 | 52 | 53 | 55 | 56 |
| Torque value (deg.) | 6.1 | 6.1 | 6 | 6 | 6 | 6 |
| Torsional stiffness GI at 150 mm position from butt end (kgf m) | 3 | 3 | 3.1 | 3.1 | 3.1 | 3.1 |
| Total distance of hit ball (yard) | 207 | 206 | 204 | 202 | 200 | 193 |
| Dispersion of hit ball (yard) | 15 | 15 | 15 | 15 | 15 | 15 |
| Strength of tip end side (T-point strength) (kgf) | 169 | 180 | 195 | 197 | 199 | 200 |
| Strength of butt end side (C-point strength) (kgf) | 61 | 76 | 85 | 86 | 87 | 88 |
| Feeling test (Four grades) | 3 | 3 | 4 | 3 | 3 | 3 |

TABLE 5

| | Ref. 7 | Ex. 11 | Ex. 2 | Ex. 12 | Ex. 13 | Ref. 8 |
|---|---|---|---|---|---|---|
| Ratio LG/LS | 0.56 | 0.56 | 0.56 | 0.56 | 0.56 | 0.56 |
| Content of low elastic modulus in butt end portion (Weight %) | 22 | 22 | 22 | 22 | 22 | 22 |
| Content of high elastic modulus in butt end portion (Weight %) | 78 | 78 | 78 | 78 | 78 | 78 |
| Content of bias fibers in butt end portion (Weight %) | 20 | 20 | 20 | 20 | 20 | 20 |
| Shaft weight (g) | 52 | 52 | 52 | 52 | 52 | 52 |
| Torque value (deg.) | 8.1 | 8 | 6 | 5.6 | 5.2 | 4.9 |
| Torsional stiffness GI at 150 mm position from butt end (kgf m) | 1.4 | 1.8 | 3.1 | 3.2 | 3.5 | 3.6 |
| Total distance of hit ball (yard) | 205 | 204 | 204 | 204 | 205 | 205 |
| Dispersion of hit ball (yard) | 25 | 20 | 15 | 15 | 18 | 22 |
| Strength of tip end side (T-point strength) (kgf) | 169 | 180 | 195 | 190 | 185 | 178 |
| Strength of butt end side (C-point strength) (kgf) | 61 | 76 | 85 | 80 | 78 | 72 |
| Feeling test (Four grades) | 3 | 3 | 4 | 3 | 3 | 1 |

From the test results, it was confirmed that the golf clubs of the Examples according to the present invention can be improved the feeling of golf swing, and strengths of tip end side and the butt end side of the club shaft while increasing the total distance of hit balls.

While, the reference 1 cannot be improved the total distance of hit ball as the ratio of LG/LS thereof is small. On the other hand, the reference 2 cannot improve the strength of the tip end side of the club shaft due to the large ratio of LG/LS.

The reference 3 cannot be improved the feeling of golf swings due to the large strength of butt end side.

The reference 4 cannot be improved the strength of the tip end side of the club shaft.

The reference 5 cannot be improved the strength of the tip end side and the butt end side of the club shaft due to the small weight of the club shaft. The reference 6 cannot be improved the total distance of hit ball due to the large weight of the club shaft.

The reference 7 cannot be improved the dispersion of hit balls due to the large torque value of the club shaft. The reference 8 cannot be improved the dispersion of hit balls due to the less torque value of the club shaft.

The invention claimed is:

1. A golf club shaft extending from a tip end to a butt end and made of fiber reinforced resin, comprising a weight being in a range of from 30 to 55 g, a whole length LS between the tip end and the butt end, a center of gravity of the shaft located with a distance LG from the tip end, a ratio of the distance LG to the whole length LS being in a range of from 0.54 to 0.65, a butt end portion which has a length of 300 mm from the butt end toward the tip end, the butt end portion including fibers including a low elastic fiber having an elastic modulus in a range of from 5 to 20 $t/mm^2$, and a high elastic fiber having an elastic modulus greater than 20 $t/mm^2$ and not more than 50 $t/mm^2$, and said fibers in the butt end portion comprising, in weight, the low elastic fiber of from 20 to 30% and the high elastic fiber of from 80 to 70%.

2. The golf club shaft according to claim 1, wherein said fibers in the butt end portion include a bias fiber inclined at an angle with respect to an axial direction of the shaft, and the bias fiber is contained from 15% to 25% in weight of whole fibers in the butt end portion.

3. The golf club shaft according to claim 1 or 2, wherein the shaft has a torque value being in a range of from 5.0 to 8.0 degrees, and torsional stiffness GI at a position of 150 mm length from the butt end of the shaft is not more than 2.5 $kgfm^2$.

4. The golf club shaft according to claim 1 or 2, wherein the ratio of the distance LG to the whole length LS is in a range of from 0.55 to 0.64.

5. The golf club shaft according to claim 1 or 2, wherein the ratio of the distance LG to the whole length LS is in a range of from 0.56 to 0.63.

6. The golf club shaft according to claim 1 or 2, wherein said fibers in the butt end portion comprise, in weight, the low elastic fiber of from 21 to 29% and the high elastic fiber of from 79 to 71%.

7. The golf club shaft according to claim 1 or 2, wherein said fibers in the butt end portion comprise, in weight, the low elastic fiber of from 22 to 28% and the high elastic fiber of from 78 to 72%.

8. The golf club shaft according to claim 3, wherein said torsional stiffness GI at a position of 150 mm length from the butt end of the shaft is in a range of from 1.0 to 2.3 $kgfm^2$.

9. The golf club comprising a club shaft according to claim 1 or 2, and a golf club head.

* * * * *